US007998040B2

(12) United States Patent
Kram et al.

(10) Patent No.: US 7,998,040 B2
(45) Date of Patent: Aug. 16, 2011

(54) FORCE ASSISTANCE DEVICE FOR WALKING REHABILITATION THERAPY

(75) Inventors: Rodger Kram, Nederland, CO (US); Jesse R. Modica, Lafayette, CO (US); Jinger S. Gottschall, Atlanta, GA (US)

(73) Assignee: The Regents of the University of Colorado, Boulder, CO (US)

( * ) Notice: Subject to any disclaimer, the term of this patent is extended or adjusted under 35 U.S.C. 154(b) by 335 days.

(21) Appl. No.: 11/401,168

(22) Filed: Apr. 10, 2006

(65) Prior Publication Data

US 2006/0229167 A1 Oct. 12, 2006

Related U.S. Application Data

(60) Provisional application No. 60/670,331, filed on Apr. 11, 2005.

(51) Int. Cl.
*A63B 21/02* (2006.01)
*A63B 22/04* (2006.01)

(52) U.S. Cl. ..... 482/124; 482/54

(58) Field of Classification Search ..... 482/54, 482/69, 66, 129, 130, 122–124; 601/5, 23, 601/27, 34, 35
See application file for complete search history.

(56) References Cited

U.S. PATENT DOCUMENTS 5,252,859 A * 10/1993 Tagney, Jr. ..... 290/1 R
5,444,812 A * 8/1995 Thibodeau ..... 388/840
5,603,677 A 2/1997 Sollo
6,123,649 A * 9/2000 Lee et al. ..... 482/54
6,261,212 B1 * 7/2001 Vallone et al. ..... 482/120
6,454,679 B1 * 9/2002 Radow ..... 482/4
6,595,904 B1 7/2003 Staffa
6,666,798 B2 12/2003 Borsheim
6,666,831 B1 * 12/2003 Edgerton et al. ..... 600/587
7,331,906 B2 * 2/2008 He et al. ..... 482/69
2004/0043879 A1 3/2004 Huang
2004/0087418 A1 * 5/2004 Eldridge ..... 482/54

OTHER PUBLICATIONS

Jesse R. Modica and Rodger Kram; Metabolic Energy and Muscular Activity Required for Leg Swing in Running; Journal of Applied Physiology; vol. 98 Jun. 2005; pp. 2126-2131; Copyright 2005 the American Physiological Society.

Jinger S. Gottschall and Rodger Kram; Energy Cost and Muscular Activity Required for Leg Swing During Walking; Journal of Applied Physiology; vol. 99 Jul. 2005; pp. 23-30; Copyright 2005 the American Physiological Society.

(Continued)

*Primary Examiner* — Allana Lewin
(74) *Attorney, Agent, or Firm* — Dorsey & Whitney LLP

(57) ABSTRACT

A physical therapy apparatus for use in conjunction with a treadmill provides an assistive force to a forward movement of the legs. A force assistance device is adapted to attach to the feet or legs of a patient positioned on a motorized treadmill to assist in walking therapy by providing an assistive force to a forward movement of the patient's feet or legs. An adjustment device may vary an interface of attachment, for example, the height or direction, between the force assistance device and the patient's feet or legs. A force arresting device may arrest the assistive force provided by the force assistance device during the forward movement of the patient's feet or legs. The force assistance device provides a substantially constant assistance force during the forward movement of the patient's feet or legs. The physical therapy device may also include a force adjustment device connected with the force assistance device to vary the magnitude of the assistive force.

14 Claims, 4 Drawing Sheets

OTHER PUBLICATIONS

Jesse R. Modica; Energy Cost and Muscular Activity Required for Leg Swing in Running; University of Colorado at Boulder, Department of Kinesiology and Applied Physiology—Thesis; pp. 1-45; May 2003.

Jinger S. Gottschall; Forward Propulsion, Leg Swing, and Hill Locomotion; University of Colorado at Boulder, Department of Integrative Physiology—Thesis; pp. 31-63; May 2004.

* cited by examiner

FORCE ASSISTANCE DEVICE FOR WALKING REHABILITATION THERAPY

CROSS-REFERENCE TO RELATED APPLICATIONS

The present application claims the benefit of priority pursuant to 35 U.S.C. §119(e) of U.S. provisional application No. 60/670,331 filed Apr. 11, 2005 entitled "External leg swing assist for treadmill walking rehabilitation therapy," which is hereby incorporated herein by reference in its entirety.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. NIH R-29 AR44688 awarded by the National Institutes of Health.

BACKGROUND

1. Field of the Invention

This invention relates generally to physical therapy devices for rehabilitation of patients with leg and spinal cord injuries or other gait pathologies. More particularly, this invention relates to physical therapy devices for use in conjunction with a treadmill for assisting in the movement of the legs of a patient.

2. Description of the Related Art

Patients with impaired walking ability or paralysis due to spinal cord or brain injury, stroke, or other neurological or orthopedic condition are often prescribed physical therapy for rehabilitation and maintenance of muscle strength. Traditionally, walking therapy is performed on a motorized treadmill and the patient is assisted, in the case of impairment to both legs, by three physical therapists. The patient is suspended above the treadmill in a torso harness attached to a fixed or limited movement point. Two of the therapists, one for each leg, manually advance the patient's legs to impart a walking stride. The treadmill drags the patient's foot through the rearward portion of a walking swing motion. At the completion of the rearward movement, each therapist lifts one of the patient's feet from the treadmill and swings the foot and leg forward to place it on the belt toward the front of the treadmill to begin the walking cycle again. A third therapist is generally required to assist the patient in maintaining a generally constant position over the center of the treadmill by counteracting the rearward force of the treadmill.

While effective, manually assisted walking therapy does have some drawbacks. A significant disadvantage is the physical exertion required on the part of the therapists. Assisting with patient leg movement is physically taxing and can generally only be performed for a few minutes at a time. Further, manual leg manipulation can cause detrimental physical effects in the therapists, notably repetitive motion stress disorders from the constant movement of the patient's legs and back strain due to the low, crouched position required to manipulate the foot and lower leg of a patient.

In recent years, the introduction of robotic-assisted walking therapy has reduced the physical exertion required of the physical therapist to conduct the walking therapy. One exemplary robotic assist device is the LOKOMAT® Robotic Gait Orthosis (Hocoma AG-Volketswil, Switzerland). As with regular therapy, a patient with significant paralysis is generally suspended above a motorized treadmill in a harness in a standing orientation with the patient's feet in contact with the treadmill. Alternatively a patient with some weight bearing capacity may be minimally assisted with a weight harness or support himself, perhaps with the assistance of rails. A robotic exoskeleton is then fastened to the legs of the patient, which when activated causes the patient's legs to move in a regular walking motion as the motorized treadmill moves underneath the feet of the patient. The robotic assist thus replaces two of the three physical therapists that previously manually manipulated the patient's legs. The device thus reduces labor costs in the rehabilitation process as well as fatigue and potentially repetitive stress or back injuries suffered by the therapists. At least one physical therapist is still required to operate the device and monitor the treatment.

While the robotic assist devices offers several advantages over traditional manual walking therapy, there are several disadvantages. The most significant disadvantage is the high cost of the robotic assist device and therefore limited patient access and availability. In fact, very few rehabilitation treatment facilities today are equipped with such devices. Thus, many patients who could benefit from such treatment do not have access. Additionally, there has been some concern with limitations of the efficacy of the robotic assist devices. While a robotic assist device does provide some muscle exercise for patients, it can also encourage patients to minimize their own exertion and efforts because the robotic assist will perform all the movement for the patient. Further, the robotic assist devices are very controlled in the movements they impart to the legs and thus lack the benefit that more natural leg movements can impart.

The information included in this Background section of the specification, including any references cited herein and any description or discussion thereof, is included for technical reference purposes only and is not to be regarded subject matter by which the scope of the invention is to be bound.

SUMMARY

A physical therapy device, generally for use in conjunction with a treadmill, provides an assistive force to the forward movement of the legs. In an exemplary implementation, the device assists a patient in moving his legs in the forward swing of a walking stride. The device has at least one cord for attachment to the foot or leg of the patient. A stop plate defining at least one aperture is positioned in front of the patient's position on an associated motorized treadmill. The cord is threaded through the aperture. The stop plate may be vertically or laterally adjusted. A cord stop is fixed to the cord and positioned between the patient's position on the associated treadmill and the stop plate. The cord stop is configured such that it cannot pass through the aperture. An elastic member is attached to the cord for resisting movement of the cord. The elastic member is positioned on the opposite side of the stop plate from the cord stop. The device may also comprise a weight assist means to support at least some of the weight of the patient. The device may further comprise a forward propulsion assist means to maintain the position of the patient on the motorized treadmill.

Other features, details, utilities, and advantages of the present invention will be apparent from the following more particular written description of various embodiments of the invention as further illustrated in the accompanying drawings and defined in the appended claims.

DETAILED DESCRIPTION

A physical therapy apparatus for use in conjunction with a treadmill provides an assistive force to a forward movement of the legs. A force assistance device is adapted to attach to the feet or legs of a patient positioned on a treadmill, which may be motorized, to assist in walking therapy. The force assistance device provides an assistive force to a forward movement of the patient's feet or legs. An adjustment device may vary an interface, for example, the height or direction, of attachment between the force assistance device and the patient's feet or legs. A force arresting device may arrest the assistive force provided by the force assistance device during the forward movement of the patient's feet or legs. The force assistance device provides a substantially constant assistance force during the forward movement of the patient's feet or legs. The force assistance device may also be adapted to provide a resistive force to the rearward movement of the patient's feet or legs on the treadmill. The resistive force may also be substantially constant during the rearward movement of the patient's feet or legs. The physical therapy device may also include a force adjustment device connected with the force assistance device to vary the magnitude of the assistive force.

In one implementation, the force assistance device may be in the form of a leg swing assist device. The leg swing assist is used in conjunction with a motorized treadmill for providing rehabilitative walking therapy to patients with mobility impairments in or paralysis of the legs. The motorized treadmill provides rearward stride assistance to the patient while the swing assist device provides assistance to the forward swing of a walking stride.

In an exemplary implementation, the motorized treadmill moves the patient's foot and leg rearward due to frictional engagement between the bottom of the patient's foot (or sole of the shoe) and the moving motorized treadmill belt. The swing assist device comprises an elastic or spring force device attached to the dorsum of the patient's foot, the ankle, the knee, or other part of the leg to provide a forward propulsive force on the foot and leg to move the leg forward from the rear of the stride. The spring force pulls on the front of the foot or leg to swing the leg to the forward position of a walking stride. The frictional force between the patient's foot and the treadmill during the rearward stride counters the forward, propulsive force of the spring device and in fact increases the tensile force of the spring device on the patient's leg when the motorized treadmill pulls the leg rearward. It is desirable to limit the exertion of the spring force on the leg through only a portion of the stride. In exemplary trials, it has been found useful to initiate the forward spring force halfway through the rearward stride movement of the leg and likewise to arrest the forward spring force halfway through the forward swing movement of the leg.

Figure 1:
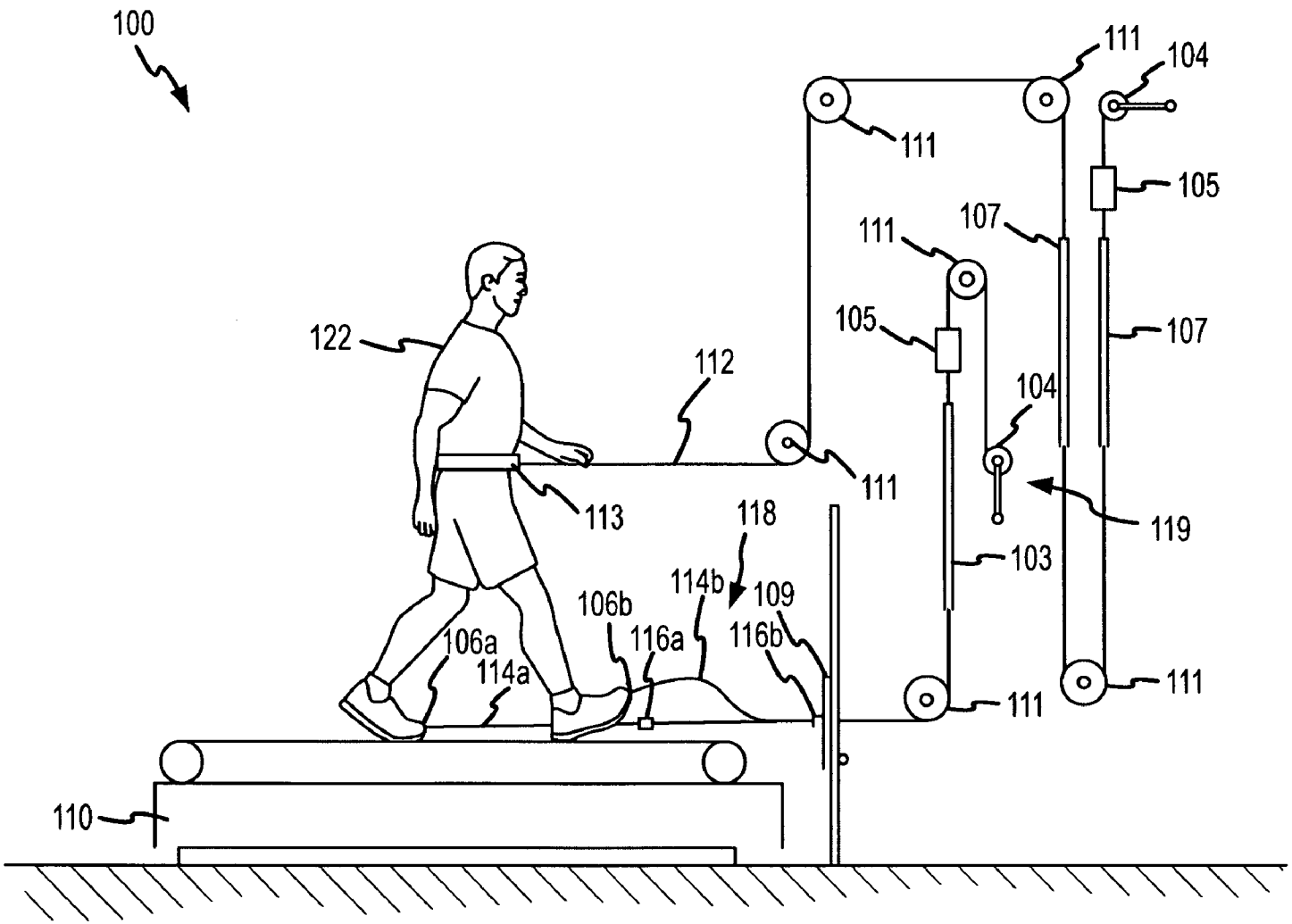
FIG. 1 is a schematic view of a leg swing assist device with a forward propulsion waist tether.
Figure 2:
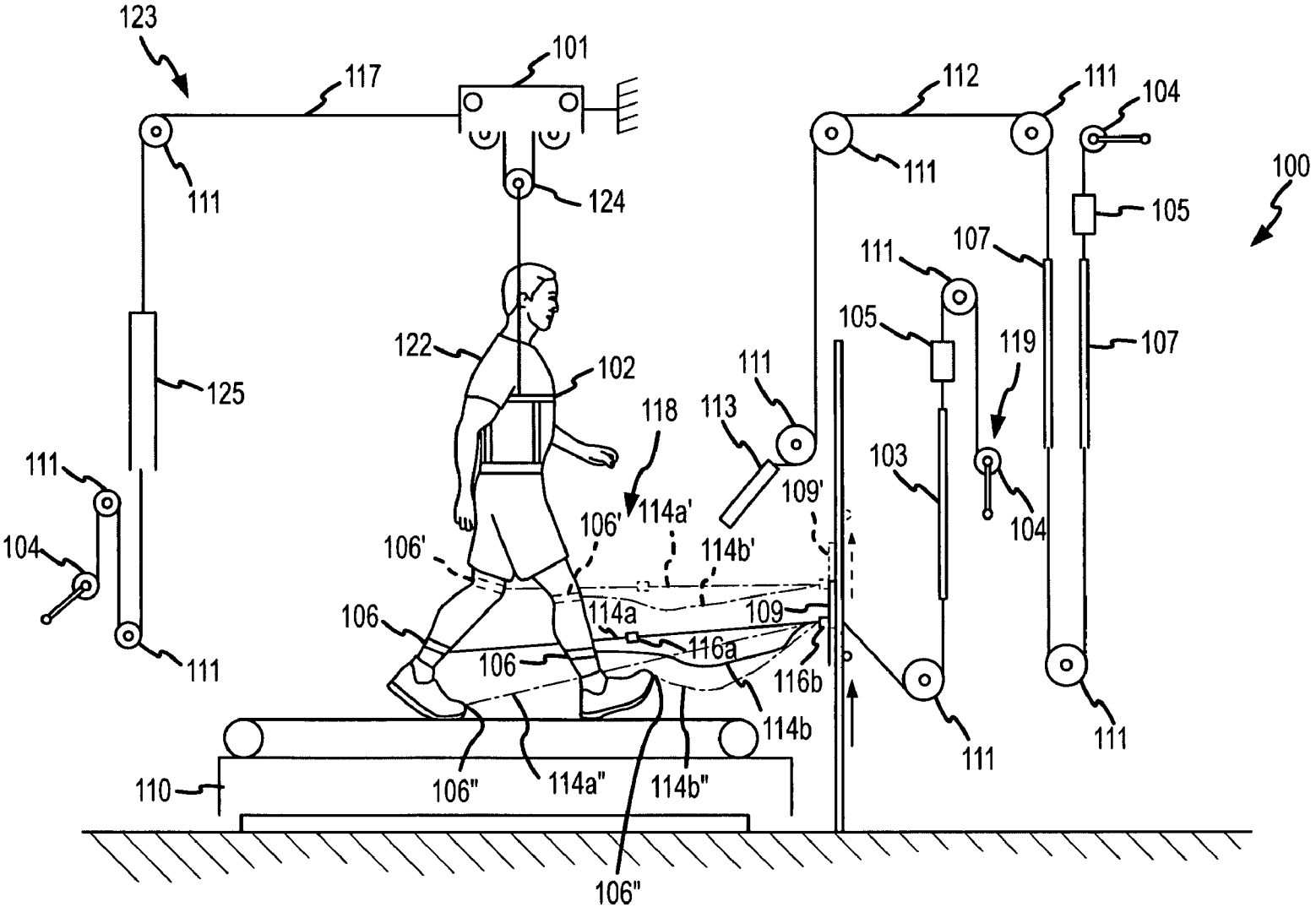
FIG. 2 is a schematic view of the leg swing assist device of FIG. 1 with a weight assist and configured for attachment to the foot, ankle, knee, or other parts of the leg.

FIG. 1 is a schematic diagram of a leg swing assist device 100 according to one embodiment of the present invention. FIG. 2 schematically depicts an alternate embodiment of the leg swing assist device 100 of the present invention incorporating a weight assist device and indicating various configurations of the invention. The leg swing assist device 100 primarily comprises an adjustable spring force mechanism designed for attachment to one or both feet or legs of a patient 122 to assist in rehabilitation therapy. The adjustable spring force mechanism is composed of one or two substantially inelastic cables or cords 114*a*, 114*b* with an elastic or spring member 103 spliced intermediately along the length of each cord 114*a*, 114*b* between the active ends 118 and the terminal ends 119 of the cords 114*a*, 114*b*. The elastic or spring member 103 may be any appropriate elastic material or spring device capable of stretching or deforming to create an increased tensile force at each end of the cords 114*a*, 114*b*, and of contracting or reforming to return to a lesser equilibrium tensile force exerted on the cords 114*a*, 114*b*.

In the schematics of FIGS. 1 and 2, the elastic members 103 are comprised of one or more pieces of rubber tubing connected between sections of the cords 114*a*, 114*b* toward the terminal ends 119. In alternate embodiments, the elastic members 103 may any of a variety of resistance force means, for example, rubber tubing, a coil spring, a retractable spiral spring, a deflectable shaft as found in certain pieces of known exercise equipment (e.g., BOWFLEX®), a scissor or leaf spring, a hydraulic or pneumatic resistance device, or any other appropriate material or device with the requisite, resilient spring force properties. In other embodiments, the resistance force means may be subject to control, e.g., through use of an electronically controlled actuator. In some designs, it may be undesirable to use springs to avoid possible negative effects of resonant states that may occur.

Figure 4:
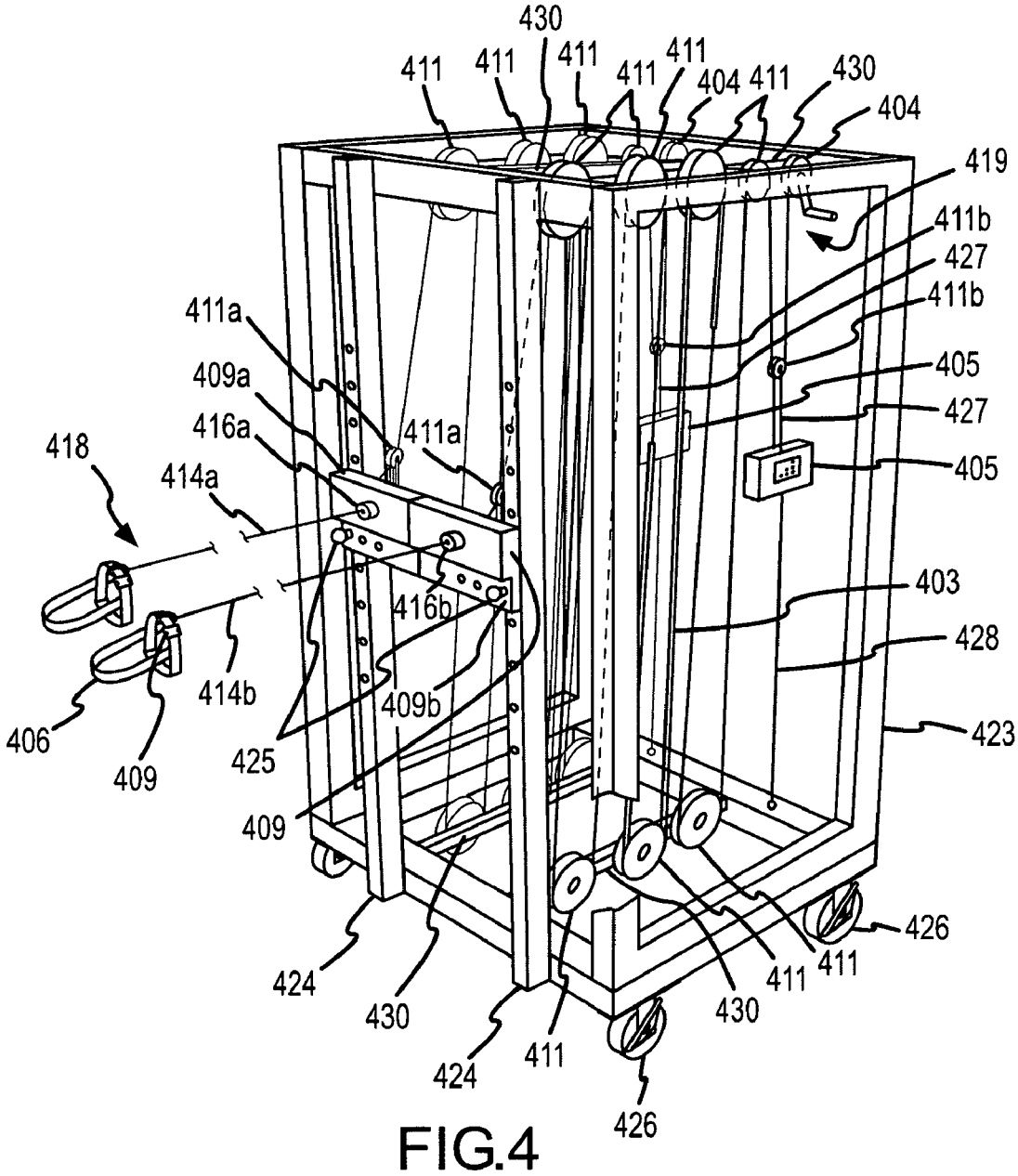
FIG. 4 is an isometric view of a mobile leg swing assist device with a foot harness.

As shown in FIGS. 1 and 2, two cords are provided, a left cord 114*a* for attachment to the left foot of the patient 122 via a first connector 106*a* at the active end 118, and a right cord 114*b* for attachment to the right foot of the patient 122 via a second connector 106*b* at the active end 118. The connectors 106*a*, 106*b* can be simple hooks or fasteners for attaching to the shoelaces of the patient's shoes as depicted in FIG. 1. Alternatively, as shown in FIG. 2, the connectors 106 may be straps for fastening around the ankle, calf, knee, or thigh of the patient 122, for example, with a VELCRO® fastener or other simple closure. An alternate leg connector may be in the form of a sleeve (not shown), similar to a knee brace that slides over the patient's leg into an appropriate or desired position. Alternately, such a leg connector may be fastened about the leg via a VELCRO® closure or other fastening device. An alternate foot connector 406 is depicted in FIG. 4 and will be further described with respect to that figure.

A stop plate 109 is interposed along the lengths of the active ends 118 of the cords 114*a*, 114*b*, between the connectors 106, 106*a*, 106*b* and the elastic members 103. Each of the cords 114*a*, 114*b* travels though a respective aperture in the stop plate 109. A cord stop 116*a*, 116*b* is attached to each of the cords 114*a*, 114*b*, in a fixed position between the connectors 106*a*, 106*b* and the stop plate 109 as shown in FIGS. 1 and 2. The cord stops 116*a*, 116*b* are positioned on the active ends 118 of each of the respective cords 114*a*, 114*b*, a short distance apart from the connectors 106*a*, 106*b* at the ends of the cords 114*a*, 114*b*.

The distance between the connectors 106*a*, 106*b* and the cord stops 116*a*, 116*b* should be determined such that the spring assist force on the forward swing motion of the patient's foot or leg is arrested by the interface between the respective cord stop 116*a*, 116*b* and the stop plate 109 when the patient's leg has completed approximately half of its forward swing motion, i.e., when the leg in forward swing is substantially parallel to the patient's torso. Generally, this distance between the connectors 106*a*, 106*b* and the cord stops 116*a*, 116*b* will be a few feet. This distance may be modified depending upon the particular rehabilitation needs of the patient 122. Thus, the cord stops 116*a*, 116*b* are adjustable along the length of the active ends 118 of the cords 114*a*, 114*b* and can be locked in any desired position.

As shown in FIG. 2, the stop plate 109 is vertically and laterally adjustable. The stop plate 109 may be adjusted vertically to alter the direction of force provided for the leg swing assist or to facilitate attachment to a connector 106 in a different location on the patient 122, for example, around the ankle, at the knee, or at some other point along the length of the patient's leg. For example, as shown in FIG. 1, the stop plate 109 may be vertically positioned such that the cord apertures in the stop plate 109 are at substantially the same vertical height as the dorsa of the patient's feet to which the connectors 106*a*, 106*b* are attached. In an alternative configuration as shown in FIG. 2, the stop plate 109 may be raised above the height of the dorsa of the patient's feet where the connectors 106" on the cords 114*a*", 114*b*" are attached in order to provide a vertical lift component to the swing assist if such a vertical lift would be helpful to the patient's rehabilitation. All of the pulleys 111 may be adjustable laterally and the first set of pulleys 111 adjacent the stop plate 109 is adjustable vertically so as to be aligned with the apertures in the stop plate 109.

Alternatively, if the cords 114*a*, 114*b* were to be attached to the lower legs of a patient 122 via the connectors 106 as shown in FIG. 2, the raised position of the stop plate 109 would be generally at the same vertical height as the patient's lower legs to provide a horizontal pull rather than an downward force component if the stop plate 109 remained at the same height as the patient's feet. Similarly, if the connectors 106' are placed on the patient's knees, the stop plate 109 may be raised even higher vertically such that it is generally at the same height as the patient's knees allowing the cords 114*a*', 114*b*' to be positioned generally at the same height as the patient's knees. Again, the stop plate 109 may be placed in any position vertically with respect to any position of the connectors 106 on the patient 122 to provide a variable angle for the pulling force to meet the particular needs of a patient 122.

Further, the stop plate may be laterally adjustable in order to account for variations in the width of a patient's stance or walking gait. In this embodiment, the stop plate may be composed of two halves (not shown), each half interfacing with respective one of the cords. The halves of the stop plate may be spaced at variable distances apart, for example, along a track, to best accommodate the structure of a patient's body. In this manner, each half of the stop plate may also be independently vertically adjustable as well. Independent vertical adjustment may be desirable in a situation when the most effective therapy for a patient 122 requires, for example, a greater amount of vertical force on the leg swing assist for one leg than for the other leg. In a similar configuration, it may be desirable for effective therapy to connect the leg swing assist to the knee of a patient 122 on one leg and to the foot on the patient on the other leg.

The terminal ends 119 of each of the cords 114*a*, 114*b* may be attached to a respective or common force adjustment device 104. An exemplary force adjustment device 104 as depicted in FIGS. 1 and 2 is a winch with a hand crank, which allows increased tension to be independently placed upon each the cords 114*a*, 114*b* and respective elastic members 103. Other exemplary force adjustment means or devices may include a cable ratchet, a motorized winch, an array of successively more distant attachment points for termination of the cords 114*a*, 114*b*, or merely a single tie-down point allowing for manually increased tension and fixation of the tension level at the attachment point. In one embodiment, in order to adjust the tension placed on the cords 114*a*, 114*b*, elastic or spring members 103 of varying tensile forces may be substituted intermediately between the active ends 118 and the terminal ends 119 of the cords 114*a*, 114*b*.

As shown in the figures, the cords 114*a*, 114*b* are threaded through a series of pulleys 111 between the stop plate 109 and the force adjustment device 104 at the terminal ends 119. These pulleys 111 are used to route the lengthy cords 114*a*, 114*b* and attached elastic members 103 within a frame to orient and connect the cords 114*a*, 114*b* variously to the stop plate 109 and the force adjustment device 104 at the terminal end 119. It should be apparent that greater or fewer pulleys 111 could be used to achieve the same result and selection of the number and placement of pulleys 111 merely depends upon the space available in the desired frame configuration. Further, a generally linear, horizontal arrangement of the cords 114*a*, 114*b* is conceivable wherein there would be no need for the use of pulleys.

A force transducer 105 may be additionally inserted intermediately along the lengths of each of the cords 114*a*, 114*b* in order to provide an accurate measurement of the force being applied by the adjustable spring force mechanism. As shown in FIGS. 1 and 2, the force transducer 105 may be placed between the elastic members 103 and the force adjustment devices 104. In general, the force transducer 105 should be positioned outside of the region of the elastic or spring member 103. It is likely most easily placed either between the elastic members 103 and terminal end 119 portions of the cords 114*a*, 114*b* attached to the force adjustment device 104, or along the length of the terminal end 119 portions of the cords 114*a*, 114*b* between the elastic members 103, 103*a*, 103*b* and the force adjustment device 104. Although possible, but likely less desirable, the force transducer 105 could be positioned along the cords 114*a*, 114*b* between the elastic members 103 and the stop plate 109.

In the embodiment shown in FIGS. 1 and 2, the leg swing assist device 100 may additionally comprise a forward propulsion tether 112, which may be used to assist the patient 122 in counteracting the rearward movement of the motorized treadmill 110. The active end 118 of the forward propulsion tether 112 may be attached to the patient 122 via a belt 113 secured about the patient's waist. The terminal end 119 of the forward propulsion tether 112 may be attached to one or more elastic or spring members 107 in much the same manner as the cords 114*a*, 114*b* in order to provide a forward force resistance to the weight of the patient 122 and the rearward force of the motorized treadmill 110. This forward force resistance increases as the patient 122 moves rearward and decreases as the patient 122 moves forward.

A force adjustment device 104 may also be connected to the terminal end of the forward propulsion tether 112 to increase the static tension on the forward propulsion tether 112. A stop plate device (not shown), similar to the stop plate 109 used with the cords 114*a*, 114*b* may similarly be used in conjunction with the forward propulsion tether 112. Further, a force transducer 105 may be connected with the forward propulsion tether 112 to measure the amount of force placed thereon. Again the use of pulleys 111 as shown in FIGS. 1 and 2 for routing the forward propulsion tether 112 are exemplary and greater, fewer, or no pulleys may likewise be used.

A shown in the embodiment of FIG. 2, a weight support device 123 may be used to help bear the weight of the patient 122 over the treadmill 110. A limited motion trolley 101 may be positioned above the treadmill 110 along a trolley cable 117. The weight support device 123 may be part of a fixed frame surrounding the treadmill motorized treadmill 110 or may be part of a mobile unit placed in position with respect to the treadmill 110. Alternative mobile lift assist devices are also available for use in conjunction with the present invention and are well known in the field of rehabilitation equipment. The trolley cable 117 may be threaded through a series of pulleys on the trolley 101. The tension on the trolley cable 117 through the pulleys of the trolley 101 may force the trolley pulleys in close interface together to frictionally engage, thus retarding forward or backward horizontal movement of the trolley 101 along the trolley cable 117. Alternatively, a block may be clamped on the gantry of the trolley 101 to prevent rearward movement of the trolley 101.

A weight support harness 102 hangs from a center, vertically-deflectable pulley 124 in the trolley 101. A patient 122 unable to support some or all of his own weight when standing on the treadmill 110, for example a patient 122 with paralysis, may be fitted into the weight support harness 102. The trolley cable 117 may be attached to an elastic or spring member 125 through a set of pulleys 111. The elastic member 125 counteracts the force of gravity on the patient 122 and helps support the patient's weight. The tension on the elastic member 125 may be increased, for example, by the use of a force adjustment device 104, to vary the level of support provided the patient 122. The patient's weight may be fully or only partially supported depending upon the need. Elastic or spring members 125 of varying resistance may also be connected with the trolley cable 117 to increase or decrease the counter-force to the patient's weight. While the patient 122 is in the harness 102, the patient's weight may deflect the vertically-deflectable trolley pulley 124 downward, allowing the trolley 101 to move forward and backward slightly in conjunction with the patient's movement on the treadmill 110.

Figure 3:
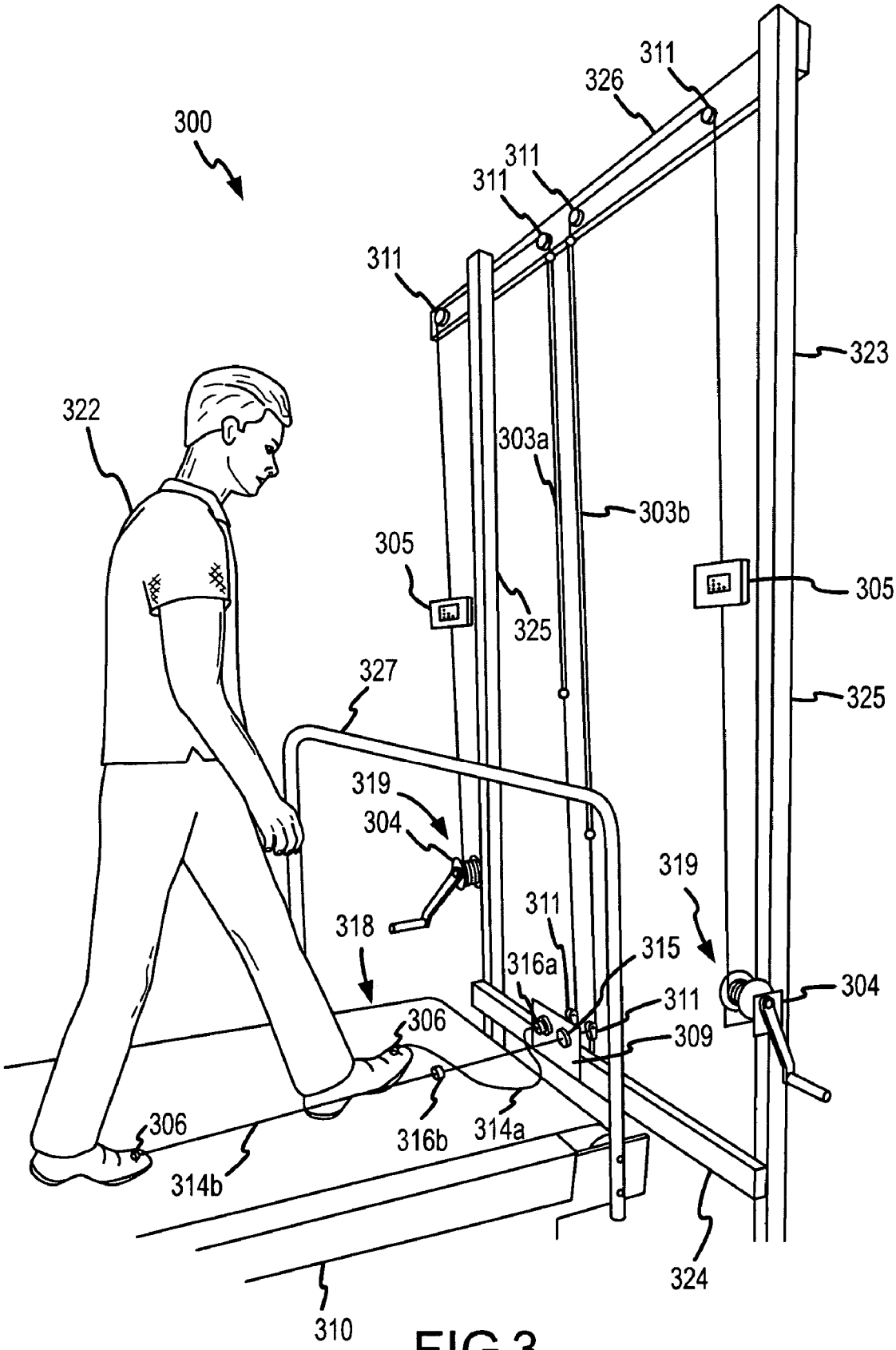
FIG. 3 is an isometric view of a stationary leg swing assist device.

One implementation of a stationary leg swing assist device 300 is depicted in FIG. 3. The foundation of the leg swing assist 300 is a stationary frame 323 adjacent which a treadmill 310 is placed. The frame 323 may be simple in construction as depicted in FIG. 3 and formed of two vertical members 325 separated by and fixed to a lower horizontal member 324 and an upper horizontal member 326 to form a generally rectangular structure. The frame 323 may be fixed in place, for example, by bolting members to the floor or ceiling or to other fixed structures. The front end of the treadmill 310 is placed adjacent the lower horizontal member 324 of the frame 323. The treadmill 310 may further be provided with a handrail 327 or multiple handrails for aiding the stability of the patient 322 while on the treadmill 310.

The adjustable spring force mechanism is composed of two substantially inelastic cables or cords 314*a*, 314*b* with elastic members 303*a*, 303*b* spliced intermediately along the length of each cord 314*a*, 314*b* between the active ends 318 and the terminal ends 319 of the cords 314*a*, 314*b*. The left cord 314*a* is attached at the active end 318 to the left foot of the patient 322 via a connector 306, and the active end 318 of the right cord 314*b* is attached to the right foot of the patient 322 via a second connector 306. The connectors 306 in this implementation are shown as simple hooks or fasteners for attaching to the shoelaces of a patient's shoes as depicted in FIG. 3. Alternative straps, sleeves, or other means for fastening around the ankle, calf, knee, or thigh of the patient 322 may also be used.

In FIG. 3, a stop plate 309 is mounted on the lower horizontal member 324 of the frame 323. The lower horizontal member 324 may be fixed to the vertical members 325 or adjustably attached to the vertical members 325 and able to move up and down. Alternatively, the stop plate 309 may be mounted on a separate adjustable member (not shown) that can move vertically up and down the vertical members 325. The stop plate 309 is interposed along the lengths of the active ends 318 of the cords 314*a*, 314*b*, between the connectors 306 and the elastic members 303*a*, 303*b*. Each of the cords 314*a*, 314*b* travels though a respective aperture in the stop plate 309. The left cord 314*a* may travel through a left sleeve 315*a* mounted within the left-hand side aperture in the stop plate 309. Similarly, the right cord 314*b* may travel through a right sleeve 315*b* in the right-hand aperture in the stop plate 309. The left and right sleeves 315*a*, 315*b* in the stop plate 309 are an optional feature and are used to provide a low friction conduit through the stop plate 309 to reduce wear on the cords 314*a*, 314*b* as they travel through the stop plate 309.

A cord stop 316*a*, 316*b* may be attached to each of the cords 314*a*, 314*b*, in a fixed position between the connectors 306 and the stop plate 309. The cord stops 316*a*, 316*b* are positioned on the active ends 318 of each of the respective cords 314*a*, 314*b*, a short distance apart from the connectors 306 at the ends of the cords 314*a*, 314*b*. The distance between the connectors 306 and the cord stops 316*a*, 316*b* should be determined such that the force assist on the forward swing motion of a patient's foot or leg is arrested by the interface between the respective cord stop 316*a*, 316*b* and the stop plate 309 when the patient's leg has completed approximately half of its forward swing motion. Generally, this distance between the connectors 306 and the cord stops 316*a*, 316*b* will be a few feet. The cord stops 316*a*, 316*b* are adjustable along the length of the active ends 318 of the cords 314*a*, 314*b* and can be locked in any desired position.

The terminal ends 319 of each of the cords 314*a*, 314*b* are attached to a respective force adjustment device. An exemplary force adjustment device as depicted in FIG. 3 is a winch 304 with a hand crank, which allows increased tension to be independently placed upon each the cords 314*a*, 314*b* and respective elastic members 303. The winches 304 are mounted to the vertical members 325 of the frame 323. The winches 304 allow the force exerted on the patient's legs to be varied depending upon, for example, the inertia of the patient's legs (i.e., a larger force may be required to move a heavier leg forward) or the stage of therapeutic treatment (i.e., as the patient improves, less force may be required to assist the patient in moving his legs).

As shown in the figures, the cords 314*a*, 314*b* are threaded through a series of pulleys 311 mounted to the upper horizontal member 326 and the lower horizontal member 324 between the stop plate 309 and the winches 304 at the terminal ends 319. These pulleys s11 are used to route the lengthy cords 314*a*, 314*b* and attached elastic members 303*a*, 303*b* within the frame 323 to orient and connect the cords 314*a*, 314*b* variously to the stop plate 309 and the winches 304 at the terminal end 319. It should be apparent that greater or fewer pulleys 311 could be used to achieve the same result and selection of the number and placement of pulleys 311 merely depends upon the space available in the desired frame configuration. In the implementation of FIG. 3, the vertical members 325 of the frame 323 are relatively tall to allow for adequate linear displacement of the elastic members 303*a*, 303*b* and travel for the cords 314*a*, 314*b*.

It should be noted that when using elastic members 303*a*, 303*b*, the length of the elastic members 303*a*, 303*b*, in addition the elastic modulus of the material of the elastic members 303*a*, 303*b*, is important to the swing effect achieved. In particular, if the elastic members 303*a*, 303*b* are too short, the stress force applied by the elastic members 303*a*, 303*b* increases rapidly and could operate to jerk a patient's leg forward to quickly. Thus, the length of the elastic members

303*a*, 303*b* should be chosen in conjunction with the elastic modulus of the material in order to provide a substantially constant force over the entire length that the elastic members 303*a*, 303*b* are stretched. This may be especially important with respect to patients with spasticity disorders (e.g., cerebral palsy) wherein if the muscles are moved to quickly, neural feedback creates spasms or a spasticity event. Further, if the elastic members 303*a*, 303*b* are too short, the available strain, i.e., length that the elastic members 303*a*, 303*b* can be stretched under a force, is very short and thus may not provide enough length for a patient to take a full stride.

Figure 5:
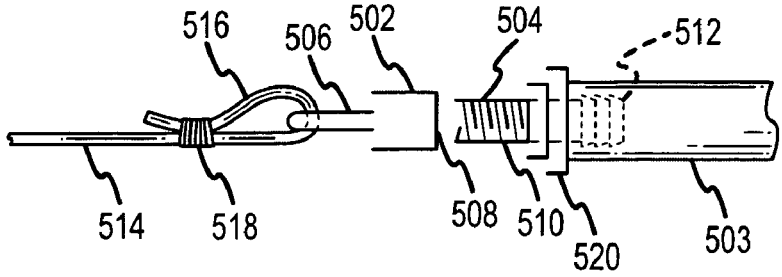
FIG. 5 is a plan view of an attachment mechanism for attaching elastic members to cord members in a leg swing assist device.

An additional or alternative method for adjusting the force imparted by the swing assist device is to substitute elastic members of various lengths or elastic members of varying elastic modulus. FIG. 5 depicts one exemplary implementation for easily substituting elastic members 503 within the leg swing assist device. As shown in FIG. 5, an end of a cord 514 adjacent to an end of an elastic member 503 is looped through a closed eye 506 of a female fastening member 502. The loop 516 of the cord is secured, for example, by a knot 518, a clamp, or any other fastening device or technique. The female fastening member 502 defines a cylindrical cavity 508 with a threaded interior wall designed to interface with threading on a male bolt.

The elastic member 503 may be a hollow rubber tube. Each end of the elastic member 503 is connected with a male fastening member 504. The male fastening member 504 may have a barbed plug end 512 and a threaded end 510. The barbed plug end 512 is inserted within the tube opening on the end of the elastic member 503. A hose clamp 520 or other fastening device may be affixed about the outer wall of the elastic member 503 at the position of the barbed plug end 512 to clamp the male fasting member 504 to the elastic member 503. The threaded end 514 of the male fastening member 504 may then be secured within the threaded cavity 508 of the female fastening member 502 to removably attach the elastic member 503 to the cord 514. In this manner, multiple elastic members may be easily substituted within the leg swing assist device.

A force transducer 305 may be additionally inserted intermediately along the lengths of each of the cords 314*a*, 314*b* in order to provide an accurate measurement of the force being applied by the elastic members 303*a*, 303*b*. The force transducer 305 may be placed between the elastic members 303*a*, 303*b* and the winches 304. In general, the force transducer 305 should be positioned outside of the region of the elastic members 303*a*, 303*b*. As shown in FIG. 3, the force transducers are placed between the elastic members 303*a*, 303*b* and the terminal ends 319 of the cords 314*a*, 314*b* attached to the winches 304.

In an exemplary practice, as generally shown in FIG. 3, a patient 322 is shown walking on the motorized treadmill 310 with the dorsum of each of the patient's feet connected to the cords 314*a*, 314*b* via simple clip connectors 306 connected to his shoelaces. In FIG. 3, the patient 322 is not significantly impaired or disabled and is thus not suspended in a harness or attached to a forward propulsion tether. FIG. 3 shows the patient 322 taking a forward stride with his left foot, while his right foot is propelled rearward through frictional engagement with the belt of the motorized treadmill 310. The initially slack right cord 314*b* is pulled taut and placed under increased tension as the patient's right foot is pulled rearward. The rearward force exerted by the motorized treadmill 310 provides the pulling force on the right cord 314*b* and the elastic member 303, as well as the right foot and leg, obviating the need for the subject to exert a significant rearward force using leg muscles.

The right cord stop 316*b* is spaced apart from the stop plate 309 and the elastic member 303 connected with the right cord 314*b* is extended from its equilibrium position by the pulling force of the treadmill to an extended position that places a constant force on the patient's foot and/or leg. Thus, the elastic member 303 is induced to exert the assistance force by the rearward movement of the patient's foot/leg on the treadmill. In contrast, the left cord 314*a* is slack at the active end 318 as the left foot has swung forward, the left cord stop 316*a* is pulled against the stop plate 309, which arrests further forward movement of the left cord 314*a*, and the respective elastic member 303*a* is in, no longer acted on by the treadmill via the patient's foot/leg, returns to its static, equilibrium position. The slackness in the left cord 314*a* is indicative that the forward swing of the patient's left leg has passed the mid-point in parallel with the subject's torso. It should be apparent that the left cord stop 316*a* would initially strike the stop plate 309 halfway through the forward swing of the left leg, thus arresting the forward propulsion force applied by the left cord 314*a* to the left leg. The forward momentum of the left leg completes the forward swing until the forward movement is arrested by the counteracting gravitational force on the mass of the leg, which causes the foot to contact the motorized treadmill belt, thus starting the rearward stride cycle for the left leg.

Similarly, although not depicted in the figures, when the patient 322 takes a forward stride with his right foot, while his left foot is propelled rearward through frictional engagement with the belt of the motorized treadmill 310, the left cord 314*a* is taught and under increased tension as the subject's left foot is pulled rearward. The rearward force exerted by the motorized treadmill 310 provides the pulling force on the left cord 314*a* as well as the left foot and leg, obviating the need for the subject to exert a significant rearward force using leg muscles. At the rearward position of the stride, the left cord stop 316*a* will be spaced apart from the stop plate 309 and the elastic member 303*a* connected with the left cord 314*a* will be extended from its equilibrium position.

In contrast, the right cord 314*b* will be slack as the right foot completes a forward swing, the right cord stop 316*b* is pulled against the stop plate 309, and the respective elastic member 303*b*, no longer acted on by the treadmill via the patient's foot/leg, returns to its static, equilibrium position. The slackness in the active end 318 of the right cord 314*b* is indicative that the forward swing of the patient's right leg has passed the medial point parallel with the patient's torso. It should be apparent that the right cord stop 316*b* would initially strike the stop plate 309 halfway through the forward swing of the right leg, thus arresting the forward propulsion force applied by the right cord 314*b* to the right leg. The forward momentum of the right leg completes the forward swing until the forward movement is arrested by the counteracting gravitational force on the mass of the leg, which causes the foot to contact the motorized treadmill belt, thus starting the rearward stride cycle for the right leg.

In actual practice, a patient with impairment or paralysis in the legs would additionally be supported in a torso harness as previously described positioned above the motorized treadmill to support the majority of the weight of the patient. It may be desirable to support less than the entire weight of the patient to ensure sufficient frictional interface between the patient's feet and the belt of the motorized treadmill. In other circumstances where the patient has some strength and muscle control of the legs, the harness may be used to support only a portion of the patient's weight to assist and reduce the burden of the patient during the therapy session. In addition, the patient may be connected to a forward propulsion tether in order to help maintain the position of the patient's body over the motorized treadmill.

In another implementation depicted in FIG. 4, the leg swing assist device may be configured as a mobile unit 400 for ease in moving and placement for use in conjunction with any available treadmill. For example, the mobile leg swing assist device 400 may be mounted on a wheeled cart or otherwise erected in a frame 423 built upon lockable casters 426. Such a mobile frame 423 may have a heavy base or be designed with adequate depth to counter balance the pulling force on the cords and tension on the elastic members.

As in the prior embodiments described above, two cords 414*a*, 414*b* are threaded through apertures within a stop plate 409 at an active end 418 and fastened to the frame 423 at a terminal end 419. The terminal ends 419 of the cords 414*a*, 414*b* may be attached to a winch 404 or other tensioning device to adjust the tension on the cords 414*a*, 414*b*. A force measurement device 405, for example, a force transducer, may be connected with the cords 414*a*, 414*b* to measure the level of force applied to the cords 414*a*, 414*b*. Elastic members 403 are inserted intermediately along the lengths of the cords 414*a*, 414*b* in order to provide an assistive force to a patient's legs while walking on an adjacent treadmill (not shown).

Because of the compact size of the mobile unit 400, the lengthy cords 414*a*, 414*b* and attached elastic members 403 necessary to provide enough length for a patient's walking stride are threaded between a collection of upper and lower pulleys 411. The upper and lower pulleys 411 may be mounted in two rows along horizontal frame members 430 mounted at the top and bottom of the frame 423. Additionally, a first pair of guide pulleys 411*a* are attached to the stop plate 409 in order to route the cords exiting the apertures in the stop plate 409 to the upper pulleys 411. A second pair of guide pulleys 411*b* may be connected with the force transducers 405 in order to provide an interface between the cords 414*a*, 414*b* and the force transducers 405 before the cords 414*a*, 414*b* terminate at the winches 404. The pulleys 411 have tracks of sufficient width and depth to accept and retain the elastic members 403 as they travel through the pulleys 411 while expanding and contracting under tension.

In order to facilitate various angles for attachment or attachment positions, the stop plate 409 may be partitioned into a left plate 409*a* and a right plate 409*b* may be adjusted vertically, laterally, or both, as previously described, to provide the most efficacious directional component for the pulling force of the swing assist. As shown in FIG. 4, the left plate 409*a* and right plate 409*b* are mounted to respective vertical members 424 mounted on the frame 323. The left plate 409*a* and right plate 409*b* have spring-loaded set pins 425 that interface with a series of apertures within the vertical members to independently adjust the height of the left plate 409*a* and right plate 409*b*. The left plate 409*a* and right plate 409*b* may also define a series of horizontally aligned apertures within which the set pins 424 may be positioned in order to independently adjust the left plate 409*a* and right plate 409*b* laterally with respect to the vertical members 424. Alternatively, the left plate 409*a* and right plate 409*b* may be provided with set screws with hand turn knobs to interface with the vertical members 424. Any other means to adjust the position of the stop plate 409 with respect to the frame may be alternately used.

In this clinical instances, it may be desirable to either pull the patient's leg at the knee or to pull the dorsum of the foot at an upward angle, or pull at both points using dual cords and connectors. For example, some patients may be afflicted with "drop foot," wherein the shin muscles (e.g., the tibialis anterior) are compromised and are unable to lift the dorsum of the foot during a forward swing and thus the foot or toes would drag against the belt of the treadmill on the forward swing. Attaching the cord at the knee can also reduce the possibility of hyperextension of the knee joint if the foot is pulled forward too hard. It should further be noted that the swing assist device of the present invention may be used to assist only one leg, for example, in the case where a patient has one leg that is physically healthy and one leg that is impaired. A typical example is in the case of a stroke in which often only one side of the patient's body is affected.

As previously indicated, the cords 414*a*, 414*b* may be attached at various positions on the patient's legs or feet, for example, on the dorsum of the foot, about the ankle, about the knee, or elsewhere along the length of the leg. The attachment positions could be the same or different for each leg. For example, a patient may have a partial leg amputation necessitating the attachment point for one leg to be above the foot while attachment to the foot for the other leg is still possible. Alternately, the particular pathology of the patient may suggest different placement of the cords 414*a*, 414*b* to achieve the most effective therapy. For example, a patient with paralytic symptoms in his legs would likely require an upward component to the forward swing assist force in order to lift his foot above the treadmill on the forward swing.

In order to assist the positioning of the cords 414*a*, 414*b* on a patient's foot, a foot harness 406 may be used. The foot harness 406 may be composed of two straps, a first strap wrapping behind the ankle and a second strap wrapping underneath the arch of the foot and over the dorsum. The first strap may be fixedly or adjustably attached to the second strap along the sides of the foot. The second strap may be adjustably attached together, for example, with an adjustment buckle or fastener 409. The foot harness can thus be easily adjusted to fit snugly on any size foot. Further, the cords 414*a*, 414*b* may be attached to any position on the harness, including the inside or outside of the foot. Variable attachment points may be desirable depending upon patient pathology. For example, it may be desirable to attach a cord 414*a*, 414*b* on the interior of the foot of a patient with a foot or leg twisted inward due to spasticity to pull the foot outward and straighten the leg.

In an alternate implementation, the leg swing assist device may be constructed integrally with a treadmill for use as a multipurpose unit. The leg swing assist device may also be constructed to incorporate a tower with a limited travel trolley and weight support harness or other patient lift device to assist in bearing the weight of the patient above the treadmill. The tower may be component-built and easily assembled about a treadmill. Again, if the leg swing assist device is a mobile unit, the base may be weighted to help counter the weight of the patient over the treadmill. Alternately, the leg swing assist device may be used with any separate weight support device configured to work in conjunction with a motorized treadmill. As indicated above, the leg swing assist device may further incorporate a forward propulsion tether to assist the patient in maintaining a generally constant position centered on the motorized treadmill.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. All directional references (e.g., proximal, distal, upper, lower, upward, downward, left, right, lateral, front, back, top, bottom, above, below, vertical, horizontal, lateral, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the basic elements of the invention as defined in the following claims.

What is claimed is:

1. A physical therapy device for use in conjunction with a treadmill, the device comprising a cord for attachment to a foot and/or leg of a patient;

a positionally adjustable stop plate defining an aperture, wherein the stop plate is configured to be positioned at an end of the treadmill and the cord is threaded through the one aperture;

a cord stop fixed to the cord and positioned between a position of the patient on the treadmill and the stop plate, wherein the cord stop is configured such that the cord stop cannot pass through the aperture; and a resilient resistance force means under no actuator control attached to the at least one cord for resisting movement of the cord, wherein the resilient resistance force means is positioned on an opposite side of the stop plate from the cord stop; and wherein at the beginning of each step, when the patient's foot is placed down on the treadmill at a weight-bearing first position and the treadmill begins to move the patient's foot and/or leg in a first direction, the cord is moved from a slack condition and placed under tension, the cord stop is pulled apart from the stop plate, the resilient resistance force means is placed under increased load from an equilibrium position, and the resilient resistance force means exerts a pulling force in a second direction on patient's foot and/or leg;

when the patient's foot and/or leg reaches a non-weight-bearing second position, the resilient resistance force means continues to pull the patient's foot and/or leg in the second direction returning the patient's foot/leg to an intermediate position when the respective cord stop strikes the stop plate; and the patient's foot and/or leg continues moving in the second direction while the cord returns to the slack condition until gravity pulls the patient's foot and/or leg into contact with the treadmill at substantially the first position.

2. The physical therapy device of claim 1, further comprising a weight assist means to support at least some of the weight of a patient.

3. The physical therapy device of claim 1, further comprising a forward propulsion assist means.

4. The physical therapy device of claim 1, further comprising a treadmill.

5. The physical therapy device of claim 1, wherein the stop plate is vertically adjustable.

6. The physical therapy device of claim 1, wherein the stop plate is laterally adjustable.

7. The physical therapy device of claim 1, further comprising a force adjustment device connected with the resilient resistance force means to increase or decrease a level of resistance force.

8. The physical therapy device of claim 1 further comprising a force measurement device connected with the at least one cord and adapted to measure a force exerted by the resilient resistance force means.

9. The physical therapy device of claim 1, wherein the physical therapy device is adapted to be mobile.

10. A physical therapy device for use in conjunction with a treadmill, the device comprising one or more cords for attachment to either or both of a patient's feet and/or legs;

a positionally adjustable stop plate defining one or more apertures corresponding to the one or more cords, wherein the stop plate is configured to be positioned at an end of the treadmill and the one or more cords are threaded through a respective one of the apertures;

a respective cord stop fixed to each of the one or more cords and positioned between a position of the patient on an associated treadmill and the stop plate, wherein each cord stop is configured such that the cord stop cannot pass through the aperture; and a respective resilient resistive force device under no actuator control attached to each of the one or more cords for resisting movement of the one or more cords, wherein each resilient resistive force device is positioned on an opposite side of the stop plate from the cord stop; and wherein at the beginning of each step, when the patient's foot is placed down on the treadmill at a weight-bearing first position and the treadmill begins to move the patient's foot and/or leg in a first direction, one of the cords is moved from a slack condition and placed under tension, the respective cord stop is pulled apart from the stop plate, the respective resilient resistive force device is placed under increased load from an equilibrium position, and the resilient-resistive force device exerts a pulling force in a second direction on patient's foot and/or leg;

when the patient's foot and/or leg reaches a non-weight-bearing second position, the resilient resistive force device continues to pull the patient's foot and/or leg in the second direction returning the patient's foot and/or leg to an intermediate position when the respective cord stop strikes the stop plate; and the patient's foot and/or leg continues moving in the second direction while the one of the cords returns to the slack condition until gravity pulls the patient's foot and/or leg into contact with the treadmill at substantially the first position.

11. The physical therapy device of claim 10, wherein the stop plate is partitioned into a left plate and a right plate;

a first of the one or more apertures is located within the left plate and a second of the one or more apertures is located within the right plate, and the left plate and the right plate are independently positionally adjustable.

12. The physical therapy device of claim 10 further comprising a respective force adjustment device connected with each respective resilient resistive force device to increase or decrease a level of resistance force.

13. The physical therapy device of claim 10, wherein each resilient resistive force device is removably attached to a respective one of the one or more cords.

14. The physical therapy device of claim 10 further comprising a respective force measurement device connected with each of the one or more cords and adapted to measure a respective force exerted by each resilient resistive force device.

* * * * *